United States Patent [19]

Neathery

[11] Patent Number: 4,957,389

[45] Date of Patent: Sep. 18, 1990

[54] METHOD AND APPARATUS FOR SEALING MANHOLES

[76] Inventor: David L. Neathery, 1830 Willow Point, Shreveport, La. 71119

[21] Appl. No.: 402,477

[22] Filed: Sep. 5, 1989

[51] Int. Cl.[5] ..... E02D 29/14

[52] U.S. Cl. ..... 404/72; 52/20; 404/25; 404/26

[58] Field of Search ..... 404/25, 26, 72, 73; 52/20

[56] References Cited

U.S. PATENT DOCUMENTS

| | | | |
|---|---|---|---|
| 3,621,623 | 11/1971 | Downes | 404/25 |
| 3,712,009 | 1/1973 | Campagna | 404/25 X |
| 4,305,679 | 12/1981 | Modi | 404/25 |
| 4,469,467 | 9/1984 | Odill et al. | 404/25 |
| 4,475,845 | 10/1984 | Odill et al. | 404/25 |
| 4,557,625 | 12/1985 | Jahnke et al. | 52/20 X |
| 4,582,449 | 4/1986 | Vosswinkel | 404/25 |
| 4,650,365 | 3/1987 | Runnels | 404/25 |
| 4,737,220 | 4/1988 | Ditcher et al. | 404/25 X |
| 4,751,799 | 6/1988 | Ditcher et al. | 52/21 |

*Primary Examiner*—Stephen J. Novosad
*Attorney, Agent, or Firm*—John M. Harrison

[57] ABSTRACT

A method and apparatus for sealing manholes which includes the installation of a donut-shaped seal structure in the chimney, cone or base of a manhole at a selected distance from the manhole cover and seating a dish-shaped manhole insert in an opening provided in the seal structure to define a manhole seal. The seal structure element of the manhole seal is installed by initially mounting a flexible form base to the chimney, the concentric or eccentric cone or the base of a manhole by means of anchor bolts and masonry anchor plugs. A flexible form is then seated on the form base and concrete is poured in the annulus between the form base and the chimney wall, in order to define the seal structure. A manhole insert seal may then be seated in the top surface of the seal structure for receiving the flange or rim of the manhole insert component of the manhole seal. In a preferred embodiment of the invention, a lift strap and plug are provided in the dish of the manhole insert and these elements are fitted with floats for locating both the lift strap and the plug when the manhole insert and the manhole above the manhole seal are filled with water. The plug can be pulled to drain the manhole insert and the lift strap then used to remove the manhole insert from the seal structure.

34 Claims, 3 Drawing Sheets

METHOD AND APPARATUS FOR SEALING MANHOLES

Background of the Invention

1. Field of the Invention

This invention relates to sealing devices for sealing the chimney, cone and/or base of manholes and more particularly, to a method and apparatus for sealing manholes using a manhole seal which includes a removable manhole insert. The apparatus for sealing manholes is characterized by a manhole seal which includes a generally donut-shaped seal structure that is mounted in the chimney, cone or base directly to the wall of the manhole at a selected distance from the manhole opening. In a preferred embodiment, a seal structure component of the manhole seal is constructed in the manhole by initially mounting a resilient form base to the manhole wall at a selected depth in the manhole, which form base conforms to the shape of the chimney, cone or base of the manhole and can be utilized in both concentric and eccentric, as well as concrete and brick manhole structures. A temporary form is then placed on the form base to define an annulus between the manhole wall and the temporary form and facilitate pouring concrete in the annulus, to define the seal structure. A seal or gasket is then seated on or embedded in the concrete while the concrete is wet, for sealing the manhole insert element of the manhole seal on the seal structure, as hereinafter described. The temporary form is then removed, leaving the seal structure in place and the dish of a dish-shaped manhole insert is positioned in the opening defined by the seal structure, with the rim or flange of the manhole insert resting on the seal structure or on the seal or gasket which is seated in or resting on the seal structure.

In many municipal sanitary sewer manhole installations the seal at the corbel joint between the flange of the manhole frame and the upper portion of the manhole masonry chimney is frequently broken from vibration due to traffic and/or temperature changes, leaving a crack where surface water may flow into the manhole. This leakage of surface water, coupled with sub-surface storm water and/or ground water which enters the sanitary sewer system through cracks in the chimney structure, frequently causes overflow conditions at waste treatment plants during or shortly after rainstorms.

In a conventional manhole structure, the manhole frame is typically fabricated of cast iron and is mounted immediately below the surface of a street or roadway to serve as a seat for manhole cover. The casting is supported by the manhole chimney, which may be constructed of concrete or brick masonry and is frequently found to be in a highly deteriorated condition due to vibration, water leakage, freezing and thawing, as well as corrosive attack by sewer gases. Accordingly, water from drainage of both surface water and sub-surface storm water, as well as ground water, flows through the corbel joint and the deteriorated chimney into the manhole and from the manhole into the sewer system, frequently overtaxing the sewerage treatment system. Since the capacity of a sewerage treatment system in large part is a measure of the volume of the effluent which can be treated, water infiltration during sudden rainstorms or during periods of extended rainfall activity add to the total volume of effluent treated. This increased volume of water may overload both new and old sewerage treatment systems and in most cases, the excess volume of effluent overload is dumped untreated into rivers and lakes.

Another problem which results from surface water infiltration into manholes is the flow of contaminated surface water, especially when the contaminant is a petrochemical or a dangerous manmade pollutant, such as PCB. Contaminated surface water which infiltrates the sewerage system through a manhole will be distributed to other sites by the sewerage lines to which the manhole assemblies are connected. Consequently, a contaminant that should be contained and safely removed from population centers may instead be widely dispersed in an uncontrolled fashion through a sewerage system.

Accordingly, there is a continuing need in the field of manhole construction for an apparatus to seal the manhole against both surface and sub-surface water, including ground water. There is also a need for a removable seal which is effective against water infiltration occurring in the manhole cover and vent or pick hole areas in the area between the casting and the supporting chimney structure and through the chimney structure, cone and base of the manhole. There further exists a need for a manhole seal that can accommodate vertical and horizontal displacement of the casting relative to the supporting masonry structure during prolonged use, which seal is removable for replacement or to allow maintenance in the manhole structure itself.

2. Description of the Prior Art

Various types of structures have been proposed in the art for sealing manholes in order to prevent, or at least minimize, the leakage of surface water and sub-surface water into manholes. Typical of this art is the manhole chimney seal detailed in U.S. Pat. No. 4,469,467, dated Sept. 4, 1984, to Frank J. Odill, et al. The patent details an internal seal which is located between a manhole casting and mating manhole components, such as concrete adjusting rings, the concrete manhole cone, or masonry structure of a similar configuration, to prevent water infiltration at this interface. The seal is formed by a continuous elastomeric ring, which ring is held in place by two stainless steel retaining bands. The ring is pleated to allow upward or lateral movement of the casting without impairing the sealing ability of the ring. The gasket can be installed either during construction or at any time after construction where there is found to be a problem with water infiltration. U.S. Pat. No. 4,475,845, dated Oct. 9, 1984, details an "External Manhole Chimney Seal". As detailed in this patent, a cylindrical elastomeric seal is designed to externally seal a manhole assembly against surface water infiltration between the manhole casing and the supporting structure, as well as through the supporting structure. The seal has a first sealing section adapted to receive the edge of the flange of a manhole casting, a second sealing section adapted to be received by the external surface of the manhole chimney or cone, and an intermediate section joining the first two sealing sections, for spanning the vertical distance between the casting and the chimney or cone. A sealing mechanism holds the two sealing sections in place against the casting and chimney, to create water-tight seals. An extension skirt increases the effective sealing area cover, allowing the entire supporting structure to be sealed under circumstances where the chimney height is too great to be spanned by the intermediate section of the seal alone.

The seal can be used on old or new construction and does not interfere with normal use of the manhole. An "Internal Sealing Assembly" is detailed in U.S. Pat. No. 4,577,625, dated Dec. 10, 1985, to Richard P. Jahnke, et al. The sealing assembly includes a tubular rubber sleeve having an axial link sufficient to span the joint between hollow members, such as the corbel joint between a manhole frame and a manhole casing, and the sealing portion in each of the opposite ends. The outer surface of each sealing portion is compressed radially outwardly in sealing engagement with the interior walls of the manhole frame and the manhole casing, by a generally circular hoop which fits into a groove provided on the inside surface of the sleeve. Each hoop has circumferentially movable end portions and a radially inwardly-extending bracket mounted on each end portion at circumferentially spaced locations. These brackets are adjustably pulled toward each other to increase the circumference of the hoop by tightening a nut threaded onto the outer end of a bolt connecting the brackets. The distance between the outer ends of the bracket can be adjusted to maintain the brackets substantially parallel during tightening, by turning a nut threaded onto the outer end of a threaded member spaced radially inwardly from the tightening bolt and connected between the brackets. U.S. Pat. No. 4,582,449, dated Apr. 15, 1986, to Gilbert Vosswinkel, details a "Manhole Sealing Device". The manhole sealing device further details a method for sealing a frame-chimney joint between a manhole chimney and a manhole cover frame and includes an annular ring defining a narrow annular space adjacent to the frame and the chimney and across the frame chimney joint and a flexible, water-resistant cement filling the annular space and adhering to the annular ring, the frame and the chimney. In one embodiment the ring includes a plurality of ring segments which are held together by slip joints and the ring includes an expansion joint to permit the adjustment of the annular space. The annular ring further includes multiple, horizontal retainers secured in the frame-chimney joint for securing the ring adjacent to the frame in the chimney. U.S. Pat. No. 4,608,787, dated Sept. 2, 1986, to Franklin J. Carlson, details a "Manhole Seal Construction". The manhole seal construction is designed to engage the outer surface of the manhole frame and chimney to seal the corbel joint from the outside and prevent leakage of water and entry of foreign material into the joint and manhole. A resilient ring having a hook-like upper section is engaged with the outwardly-extending flange on the manhole frame and the ring has a thin, stretchable central section which extends across the corbel joint. The lower portion of the ring terminates in a lower section having a series of internal ribs that seal against the chimney and having an outer circumferential groove to receive a clamping band. To provide additional sealing, an annular sealing gasket is bonded to the internal shoulder on the manhole frame and the manhole cover seats on the gasket to prevent leakage from the street into the manhole through the joint between the cover and the frame. U.S. Pat. No. 4,737,220, dated Apr. 12, 1988, to Jack Ditcher, et al, is entitled "Method of Making A Manhole Riser Having Integral Flexible Waterlock for Manhole Covers and Having a Water-Tight Seal for Sealed Manhole Covers". The device detailed in this patent includes a hollow, flexible, bendable, cylindrically-shaped, hat-like sleeve which is water-tightly joined to the upper end of the riser section of a manhole structure. The free end of the sleeve is trimmed so that its upper edge fits beneath the shoulder of the frame supporting the manhole cover, to prevent sub-surface water from entering the manhole through the regions between the manhole cover supporting frame and the top of the riser section, which is usually fitted with adjusting rings to bring the manhole cover frame up to grade. The sleeve is easily cut to any height to accommodate either a greater or lesser number of height-adjusting rings and the sleeve flange is cast into the riser section. The sleeve may be folded into itself to significantly lower its profile to expedite handling, transportation and assembly. A plastic clamping band may be placed in the interior of the sleeve to water-tightly join the upper end of the sleeve to the manhole cover support frame. A "Method and Apparatus For Lining Manhole Assemblies and the Like" is detailed in U.S. Pat. No. 4,751,799, dated June 21, 1988, also to Jack Ditcher, et al. The method and apparatus described in this patent provides liners in manhole assemblies, each of which liners includes a plurality of liner sections joined to form the inner corrosion-resistant surface of each manhole member. The liner sections define the inner surface of the manhole member being molded and cast material is poured into the mold and allowed to set. A liner surface engaging the cast material contains integral, substantially T-shaped projections which anchor the liner sections to the cast member. The tops and bottoms of each liner section extend around the surface of each section, engaging the next adjacent section joined thereto, to prevent toxic materials from reaching a cast material. The liner sections are thermoplastic vacuum formed, whereby the sheet forming the liner section is drawn against substantially T-shaped strips arranged upon the bowl member within the vacuum thermo-forming equipment to provide the integral T-shaped anchoring projections. A "Manhole Sealing Device" is detailed in U.S. Pat. No. 4,305,679, dated Dec. 15, 1981, to Arvind O. Modi. The manhole sealing device is designed to prevent water from entering a manhole through the corbel joint between the manhole casing and the cover frame. The device includes a flexible, tube-like membrane spanning the corbel joint of the manhole and provided with first sealing means above the corbel joint to seal the membrane against the inside wall of the cover frame and second sealing means located below the corbel joint to seal the flexible membrane against the inside wall of a manhole casing. That portion of the membrane located between the first and second sealing means is preferably provided with sufficient slack to form an inward fold defining an annular pocket to contain any water or other fluids entering the manhole through the corbel joint. In a preferred mode of the disclosed invention, the membrane is characterized by a bag having a closed bottom to catch water entering the manhole through or around the manhole cover. The manhole sealing device can be installed in an existing manhole without replacing any of the structural parts.

It is an object of this invention to provide a new and improved method and apparatus for sealing manholes, which apparatus is designed to utilize a removable manhole insert and a specially designed seal structure built into the manhole, for eliminating, or at least minimizing undesirable surface rainwater, sub-surface storm water and sub-surface ground water from entering a manhole and sanitary sewer system through cracks or openings in the manhole structure.

Another object of the invention is to provide a manhole seal apparatus for installation in a manhole, in order to close and substantially seal the manhole to prevent rainwater from flooding a sewerage system communicating with the manhole and vent sewer gases.

Yet another object of the invention is to provide a method and apparatus for sealing manholes which is characterized by a donut-shaped seal structure constructed in the manhole chimney, cone or base and adapted for receiving a removable manhole insert which is characterized by a dish-shaped, flanged bowl, in order to prevent, or at least reduce the flow of rainwater, including surface and sub-surface rainwater, into the manhole and the underlying disposal system.

A still further object of the invention is to provide a new and improved method and apparatus for sealing manholes by utilizing a manhole seal which is capable of sealing manholes having both concentric and eccentric cones. The manhole seal is characterized by a donut-shaped masonry ring or seal structure seated in the manhole chimney, cone or base and a dish-shaped manhole insert removably mounted in the seal structure, in order to block the flow of water into the manhole through deteriorated masonry, and yet facilitate normal manhole maintenance by removal of the manhole insert from the seal structure.

Still another object of this invention is to provide a method and apparatus for sealing new and old manhole structures from encroaching surface and sub-surface water, which apparatus includes a manhole seal characterized by a donut-shaped or elliptically-shaped seal structure formed by pouring concrete in an annulus created by a resilient, removable mold seated on a resilient form base located in the manhole chimney, cone or base and bolted to the manhole wall. A removable manhole insert having a concave dish and a rim adapted for seating on the seal structure, is installed to complete the manhole seal and block the flow of water into the manhole and the underlying sewer system.

Summary of the Invention

These and other objects of the invention are provided in a new and improved apparatus for sealing manholes, which apparatus is characterized by a donut or elliptically-shaped seal structure mounted in the chimney, cone or base of a manhole at a selected distance from the manhole opening and a removable, dish-shaped manhole insert resting on the seal structure to define a manhole seal and block the flow of water through the manhole and into the connecting sewer system. A method for sealing manholes which includes the steps of mounting a resilient form base to the wall of the manhole chimney, cone or base at a selected distance from the manhole opening; inserting a resilient, removable form in the manhole on the form base to define an annulus between the outer sides of the form and the manhole wall; pouring concrete in the annulus to create a donut-shaped or elliptically-shaped seal structure; removing the temporary form; mounting an insert seal on the seal structure; and inserting the rim of a removable, dish-shaped manhole insert on the insert seal with the dish-shaped, concave bottom of the manhole insert extending into the opening defined by the seal structure, for sealing the manhole against the influx of water into the manhole.

Brief Description of the Drawings

The invention will be better understood by reference to the accompanying drawings, wherein.

Description of the Preferred Embodiments

Figure 1:
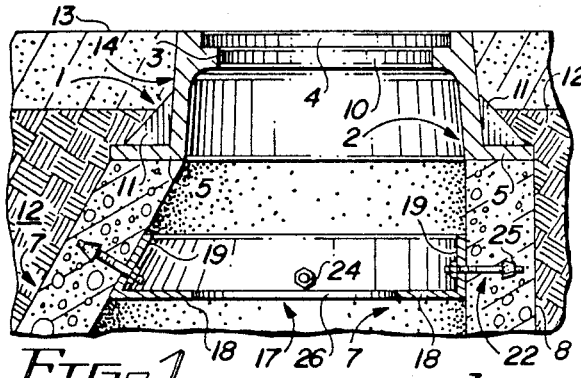
FIG. 1 is a sectional view of the upper portion of a typical manhole without a chimney, illustrating the mounting of a form base element of the manhole seal of this invention therein.
Figure 4:
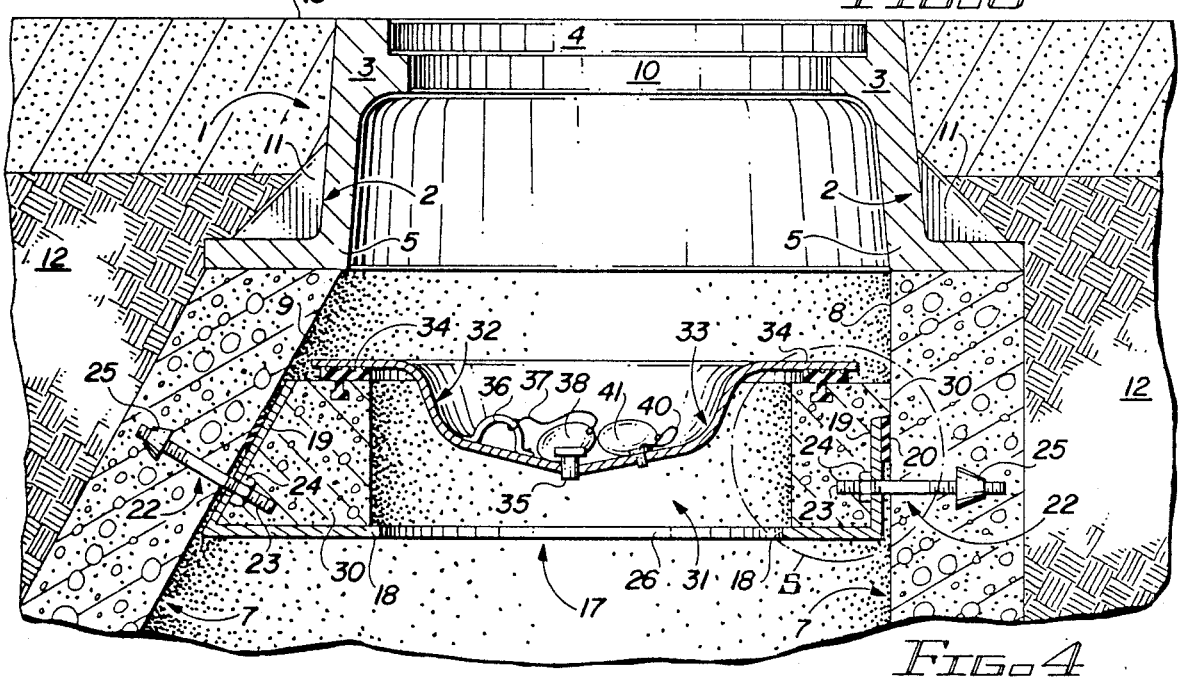
FIG. 4 is an enlarged view of the manhole illustrated in FIGS. 1-3, with the temporary form removed, the seal structure in place and a manhole insert removably inserted on the seal structure to block the manhole cone.

Referring initially to FIGS. 1 and 4 of the drawings, a sectional view of a typical manhole 1 is illustrated and the manhole 1 is provided with a manhole frame 2, typically constructed of cast iron, at the top thereof.

The manhole frame 2 is shaped to define a circular cover flange 3, for receiving a removable manhole cover 4, which lies in the manhole frame 2 approximately level and even with the adjacent road surface 13. The manhole frame 2 is further shaped to define an outwardly-extending frame leg 5, which seats the manhole frame 2 on the top of a downwardly-extending masonry cone 7, that characterizes the middle portion of the manhole 1. The cone 7 is eccentric in configuration due to the orientation of the straight cone segment 8 and the offset cone segment 9, as illustrated. A manhole mouth 10 is defined by the cover flange 3 of the manhole frame 2 and facilitates entry into the manhole 1 for purposes of maintenance when the manhole cover 4 is removed from the cover flange 3. One or more frame webs 11 may also be provided in the manhole frame 2 for increasing the structural integrity of the manhole frame 2. The frame leg 5 portion of the manhole frame 2, as well as the downwardly-extending cone 7, is surrounded by soil 12 and the cone 7 extends downwardly for connection to a base and an underlying sewer system (not illustrated). The interface between the roadway or street which defines the road surface 13 and the manhole frame 2 is commonly known as the corbel joint 14.

A manhole seal 16, illustrated in FIG. 4, is constructed in the cone 7 of the manhole 1 by means of a resilient form base 17, which is characterized by a horizontally-disposed base leg 18 and an upward-standing mount leg 19, as illustrated in FIG. 4. It will be appreciated that the upward-standing mount leg 19 is shaped at right angles with respect to the base leg 18 where the mount leg 19 curves around the straight cone segment 8. Furthermore, the mount leg 19 is bent or shaped inwardly at an acute angle with respect to the base leg 18 in the area where the mount leg 19 joins the opposite, curving, offset cone segment 9 of the cone 7. Accordingly, it will be appreciated by those skilled in the art that in a preferred embodiment the mount leg 19 of the form base 17 is easily shaped to accommodate the angular downward entry of the cone 7 toward the underlying sewer system (not illustrated), where the form base 17 is constructed of a plastic material such as polyethylene or polypropylene, in non-exclusive particular, which is well known to those skilled in the art. A mount leg seal 20 may be positioned between the mount leg 19 and the adjacent cone 7 to seal the junction. The form base 17 is further characterized by a centrally-located form base opening 26, which allows access through the manhole 1 for maintenance purposes. A concrete seal structure 30 is constructed in the outer periphery of the generally donut-shaped form base 17 and the rim 34 of a removable, dish-shaped manhole insert 32 is seated on a plastic or elastomeric manhole insert seal 43, embedded in or resting on the seal structure 30, as further illustrated in FIG. 4, to complete the manhole seal 16.

Figure 2:
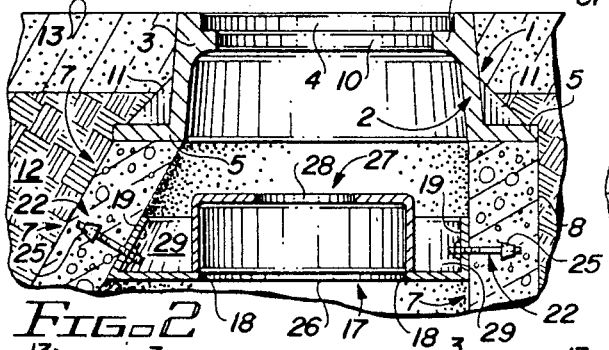
FIG. 2 is a sectional view of the manhole illustrated in FIG. 1, with a temporary form inserted on the underlying form base in the manhole.
Figure 3:
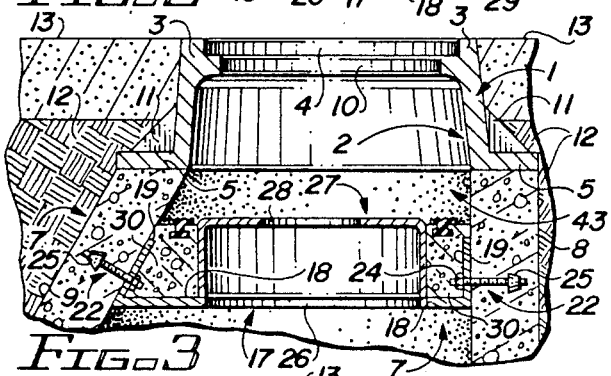
FIG. 3 sectional view of the manhole illustrated in FIGS. 1 and 2, more particularly illustrating a concrete seal structure poured in the annulus between the temporary form and the cone structure of the manhole.
Figure 5:
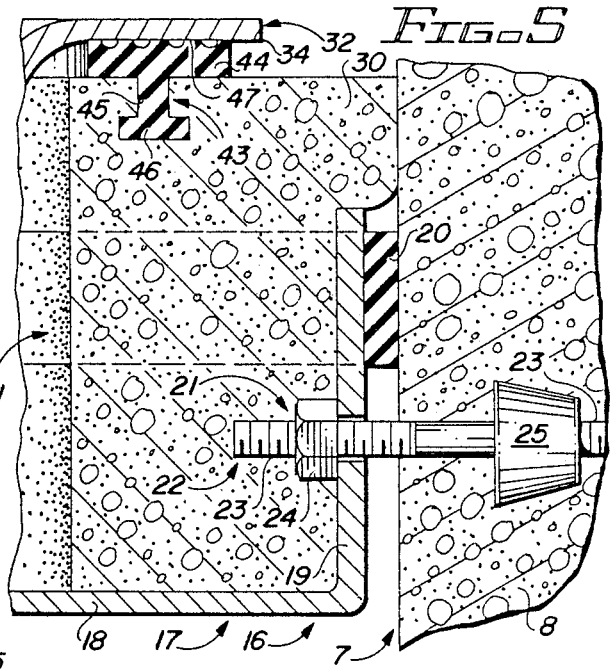
FIG. 5 is an enlarged view of a preferred configuration for the form base and illustrates a preferred technique for mounting the form base to the chimney, cone or base of a manhole and seating the manhole insert on the seal structure of the manhole seal of this invention.

Referring now to FIGS. 1–5 of the drawings, installation of the manhole seal 16 is detailed as follows. As illustrated in FIGS. 1 and 4, the resilient form base 17 is initially shaped to conform to the cone 7, the mount leg seal 20 is glued or otherwise positioned on the straight cone segment 8 and the offset cone segment 9 and the mount leg 19 is then secured to the straight cone segment 8 and the offset cone segment 9 of the cone 7, by drilling holes designed to receive spaced anchor plugs 25 and anchor bolts 26, provided with anchor bolt threads 23. When the anchor plugs 25 are inserted in the drilled openings, the anchor bolts 22 are extended through spaced openings (not illustrated) provided in the mount leg 19 and are then threadably attached to the anchor plugs 25. An anchor nut 24 is subsequently threaded on the anchor bolt threads 23 provided on the opposite end of the anchor bolts 25 to secure the mount leg 19 of the form base 17 to the straight :one segment 8 and the offset cone segment 9, respectively, against the mount leg seal 20. Referring now to FIG. 2, a round, resilient, donut-shaped temporary form 27, having a diameter which is slightly larger than the diameter of the form base opening 26 in the form base 17, is positioned on the form base 17. Like the form base 17, the temporary form 27 is preferably constructed of a resilient plastic such as polyethylene and polypropylene, in non-exclusive particular. The temporary form 27 is provided with a wall of selected height, but most preferably at least 12 inches, and a temporary form opening 28, to facilitate handling and positioning of the temporary form 27 precisely along the periphery of the form base opening 26. This positioning of the temporary form 27 on the form base 17 defines a seal structure void 29 between the vertical outer surfaces of the temporary form 27 and the upward-standing mount leg 19. As illustrated in FIG. 3, concrete is then poured into the seal structure void 29 to construct a seal structure 30 and a plastic or elastomeric manhole insert seal 43 may be embedded in the top surface of the seal structure 30 while the concrete is wet, as further illustrated in FIG. 5. In a preferred embodiment of the invention, under circumstances where the manhole insert seal 43 is utilized, the manhole insert seal 43 is characterized by a rim contact member 44, which includes multiple ribs 47, a T-leg 45 extending downwardly from the center of the rim contact member 44 and a base 46 projecting outwardly from the bottom of the T-leg 45, in order to embed the T-leg 45 and the base 46 in the seal structure 30 and receive the rim 34 of the manhole insert 32 on the rim contact member 44, as illustrated in FIGS. 4 and 5. After the seal structure 30 is poured in the seal structure void 29 and the manhole insert seal 43 is inserted in the seal structure 30 as illustrated in FIG. 3, the temporary form 27 is removed from the form base 17, leaving the substantially donut-shaped seal structure 30, as illustrated in FIG. 4. The manhole insert 32 is then positioned in the manhole 1 with the rim 34 resting on the rim contact member 44 of the manhole insert seal 43 and the dish 33 extending into the seal structure opening 31.

Figure 6:
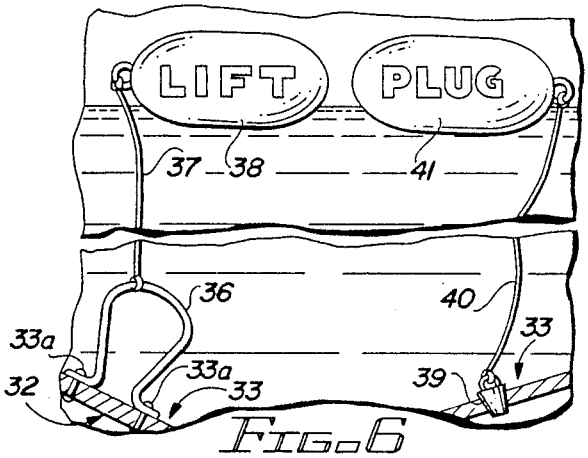
FIG. 6 is a sectional view of preferred lift strap and float, and plug and float combinations for mounting on the manhole insert, in order to facilitate draining the manhole insert and removing the manhole insert from the seal structure.

Referring now to FIGS. 4–6 of the drawings, the manhole insert 32 includes a dish 33, bordered by a rim 34. A valve 35 is located in the dish 33 for relieving pressure which may develop in the cone 7 and the underlying sewer system and a lift strap 36 is also attached to the dish 33 by means of fasteners 33*a*. A lift strap line 37 is secured to the left strap 36 and a lift strap float 38 is attached to the opposite end of the lift strap 36. A drain plug 39 is also seated in an opening provided in the dish 33 and is attached to a drain plug line 40, which secures the drain plug float 41 on the opposite end thereof. The lift strap float 38 and the drain plug float 41 are designed to float on the surface of water which may accumulate in the dish 33 of the manhole insert 32 and rise inside the upper portion of the cone 7 beneath the manhole cover 4. Accordingly, when it is desired to drain this accumulated water from the upper portion of the manhole 1, the lit strap float 38 and the drain plug float 41 locate the lift strap line 37 and the drain plug line 40, to facilitate removal of the drain plug 39 from the manhole insert dish 33 and draining of the water from the manhole insert 32. After the water is drained, the lift strap line 37 can be used to remove the manhole insert 32 from the seal structure 30 and facilitate entry into the manhole 1 past the manhole seal 16.

Figure 13:
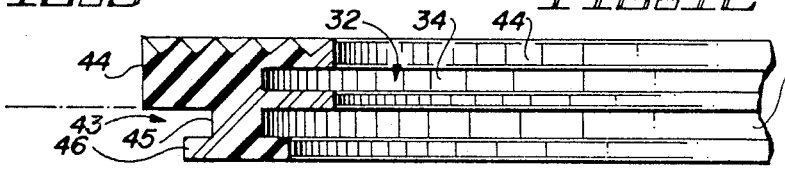
FIG. 13 is a typical manhole insert seal construction.

Referring now to FIG. 13 of the drawings, in yet another preferred embodiment of the invention the inside periphery of the rim contact member 44 of the manhole insert seal 43 is slotted to accommodate the rim 34 of the manhole insert 32, in order to better seal the manhole insert 32 in position on the seal structure 30, as illustrated in FIG. 4. Accordingly, removal of the manhole insert 32 then requires lifting of the inside periphery of the rim contact member 44 by upward pressure applied to the lift strap 36 or the lift strap line 37, in order to free the rim 34 of the manhole insert 32 and facilitate removal of the manhole insert 32 from its position on the seal structure 30. Alternatively, the rim contact member 44 of the manhole insert seal 43 can be solid and the rim 34 of the manhole insert 32 placed flat on top of the insert seal 43 for sealing purposes, as illustrated in FIG. 5.

Figure 7:
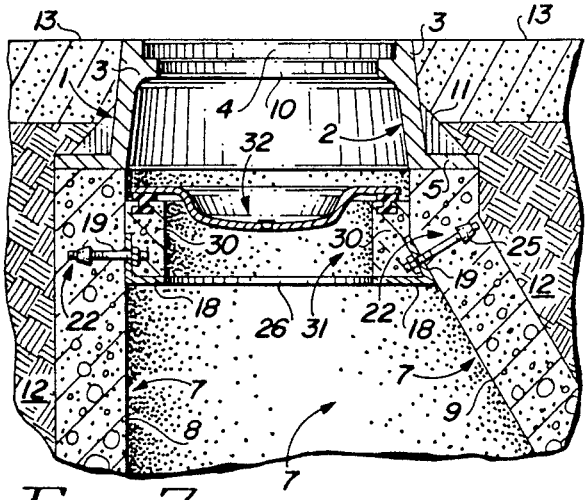
FIG. 7 is a sectional view of a newly constructed manhole having no chimney, with the manhole seal of this invention installed therein near the top of the manhole cone.

Referring now to FIGS. 7–12 of the drawings, it will be appreciated that the method and apparatus for sealing manholes of this invention is applicable to a wide variety of manhole structures for sealing purposes. For example, as illustrated in FIG. 7, an eccentric manhole 1 of new masonry construction and having no chimney is illustrated, wherein the seal structure 30 is located at a point on the cone 7 where the offset cone segment 9 angles away from the vertical portion thereof. Accordingly, that portion of the mount leg 19 in the resilient form base 17 which lies adjacent to the offset cone segment 9 is disposed inwardly at an acute angle, in order to accommodate the spaced anchor bolts 22, for securing the form base 17 in the cone 7. The opposite segment of the mount leg 19 is configured at right angles with respect to the corresponding base leg 18, for securing the form base 17 to the straight cone segment 8 of the cone 7.

Figure 8:
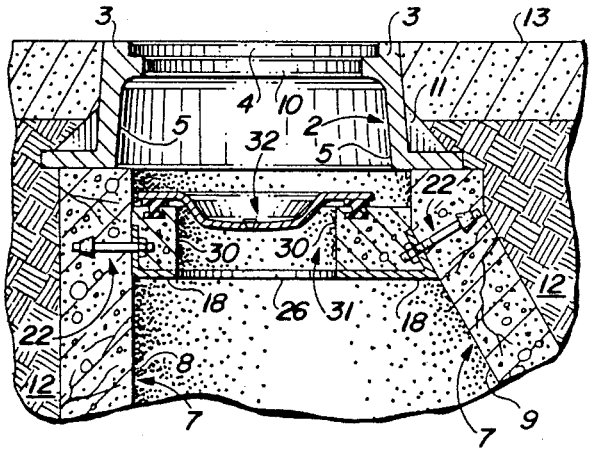
FIG. 8 is a sectional view of an old precast manhole without a chimney, having an offset manhole frame, with the manhole seal structure mounted therein near the top of the manhole cone.

Referring to FIG. 8, the manhole seal 16 is constructed in a manhole 1 which is characterized by an old precast concrete manhole having no chimney and fitted with a manhole frame 2 that has shifted since installation, and is now offset with respect to the cone 7. Under these circumstances, it will be appreciated that the form base 17 can be constructed such that the form base opening 26 is centered beneath the manhole cover 4 and the manhole mouth 10, according to techniques heretofore described. Accordingly, the temporary form 27 can also be positioned directly beneath the manhole mouth 10 as illustrated in FIG. 3, to locate the seal structure opening 31 of the seal structure 30 in registration with the form base opening 26 beneath the manhole mouth 10. The manhole insert 32 can then be installed to facilitate optional closure and re-opening of the cone 7, as desired.

Figure 9:
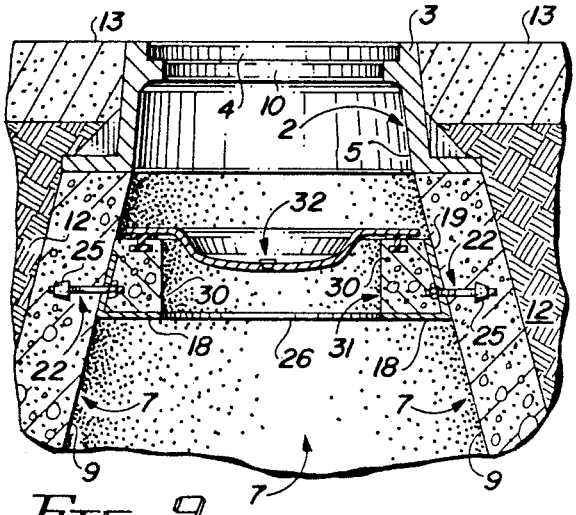
FIG. 9 is a sectional view of an old precast manhole having no chimney and having an expanding, non-vertical manhole cone, more particularly illustrating the manhole seal of this invention mounted therein.

As illustrated in FIG. 9, an old precast manhole 1 having no chimney and characterized by a continuously offset cone segment 9 which defines a continuously flairing cone 7, is illustrated. The manhole seal 16 is mounted in the flaring cone 7 by initially shaping the form base 17 to fit the flaring offset cone segment 9, securing the mount leg 19 element of the form base 17 to the cone 7, pouring the seal structure 30 and mounting the removable manhole insert 32 on the seal structure 30, as heretofore described.

Figure 10:
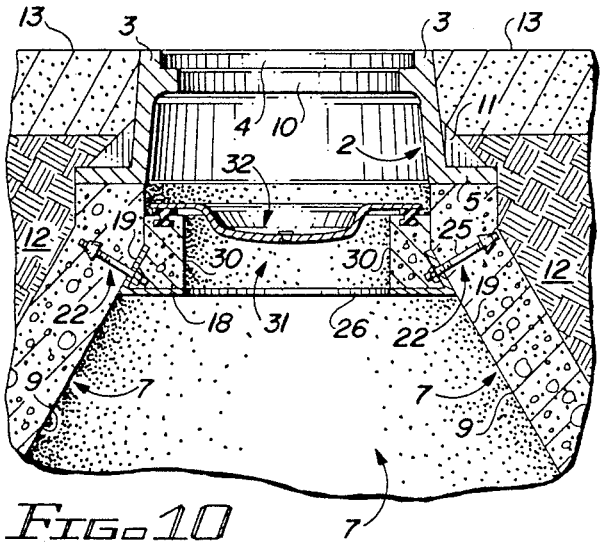
FIG. 10 is a sectional view of a newly constructed, concentric manhole structure without a chimney, having the manhole seal cf this invention constructed in the cone thereof.

Referring now to FIG. 10 of the drawings, a new, concentric, chimneyless manhole 1 is illustrated, wherein the cone 7 initially extends straight downwardly from the frame leg 5 of the manhole frame 2 and subsequently flares outwardly, as in the case of the manhole 1 illustrated in FIG. 9. Under these circumstances, the mount leg 19 of the form base 17 is shaped to fit against the flaring offset cone segment 9 of the cone 7 and the seal structure 30 is poured using the temporary form 27, as heretofore described. The manhole insert 32 is then mounted on the seal structure 30, as further heretofore described.

Figure 11:
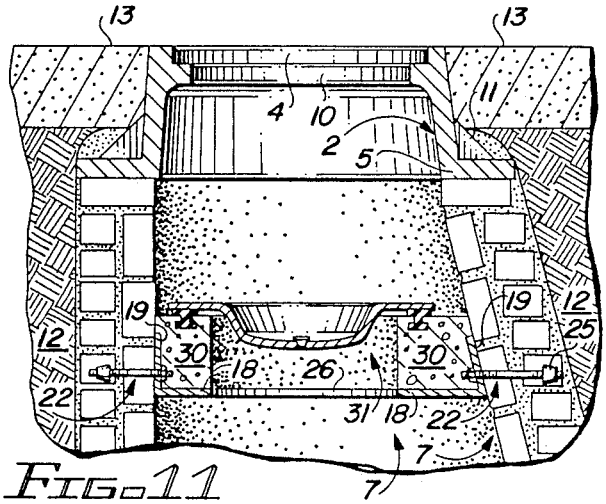
FIG. 11 is a sectional view of an old manhole cf brick construction without a chimney, having an eccentric configuration, with the manhole seal of this invention mounted in the cone thereof.

Referring now to FIG. 11 of the drawings, an old concentric brick manhole 1 having no chimney is illustrated with an offset cone segment 9 and a straight cone segment 8. As in the case of the manholes heretofore described, the base leg 18 and the mount leg 19 of the form base 17 are shaped to accommodate the straight cone segment 8 and the offset cone segment 9, the seal structure 30 is poured using a temporary form 27 in the same manner as heretofore described and a manhole insert 32 is positioned with the rim 34 thereof located on the seal structure 30 and the dish 33 extending into the seal structure opening 31.

Figure 12:
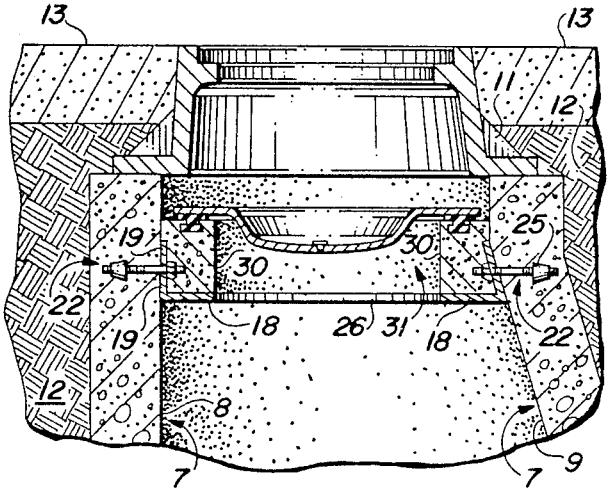
FIG. 12 is a sectional view of an old precast manhole having no chimney, but having a smaller frame and larger cone and having the manhole seal of this invention mounted in the cone.

Referring now to FIG. 12 of the drawings, an old precast masonry manhole 1 having no chimney and provided with a manhole frame 2 which is smaller than the supporting cone 7, is illustrated. Since the form base 17 can be constructed in any desired diameter to span any selected cone 7 at a desired depth in the cone 7, the base leg 18 and mount leg 19 of the form base 17 are shaped to fit the straight cone segment 8 and the offset cone segment 9 of the wider cone 7. The seal structure 30 is then poured as heretofore described and the manhole insert 32 is removably inserted on the seal structure 30, as further heretofore described.

Figure 14:
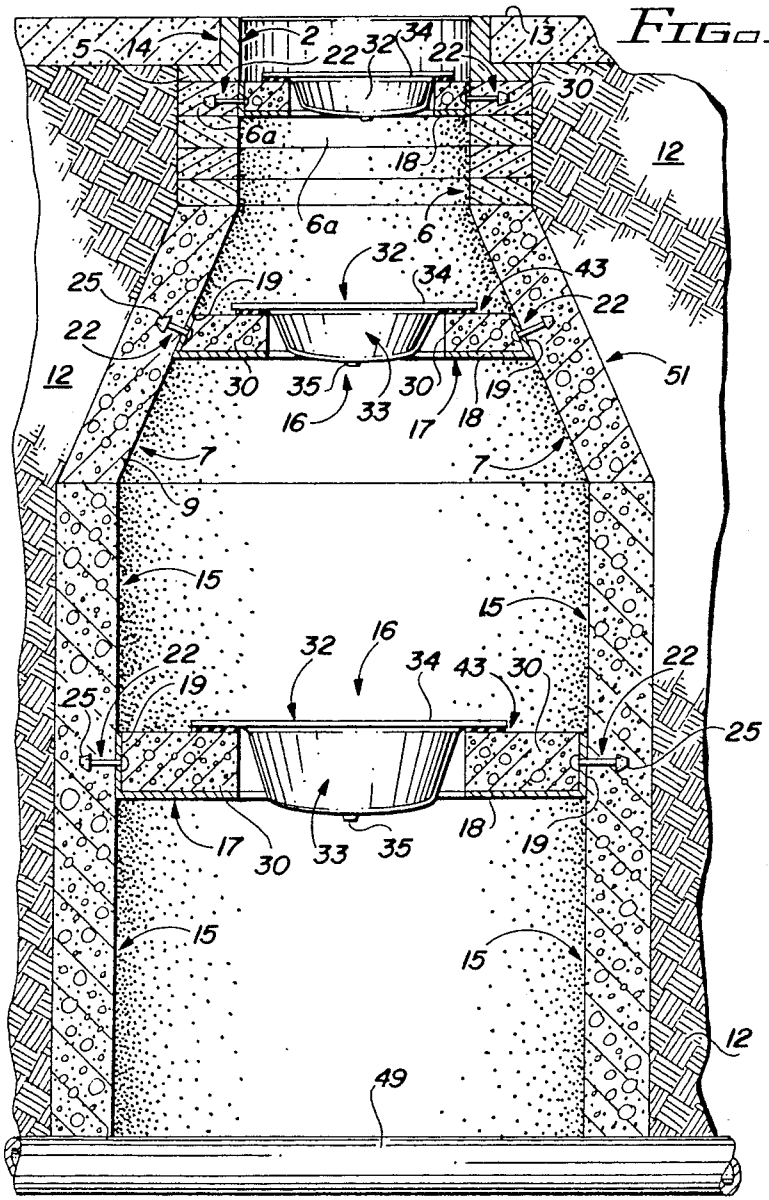
FIG. 14 is a sectional view of a typical concentric manhole with a manhole seal of this invention mounted in the chimney cone and base thereof for purposes of illustration.

Referring now to FIG. 14 of the drawings, a concentric manhole 51 is illustrated and includes a base 15, which communicates with an underlying sewer pipe 49. A tapered cone 7 projects upwardly from the top of the base 15 and a chimney 6 of substantially uniform diameter rests on the cone 7. In a typical manhole installation which utilizes such a chimney 6, the chimney 6 is characterized by multiple chimney rings 6*a* of selected thickness which are added in the chimney 6, in order to align the manhole cover 4 with the road surface 13, above the concentric manhole structure 51, using the manhole frame 2. For purposes of illustration, a manhole seal 16 is located in each of the chimney 6, cone 7 and base 15 of the concentric manhole structure 51, to illustrate the versatility of the method and apparatus for sealing manholes of this invention. It will be recognized from a consideration of FIG. 14 that the manhole seal 16 is characterized by the identical seal structure 30 and manhole insert 32 combination which is illustrated in FIGS. 1–13 and this structure is installed in the same manner as that illustrated in FIGS. 1–4 and described above.

Figure 15:
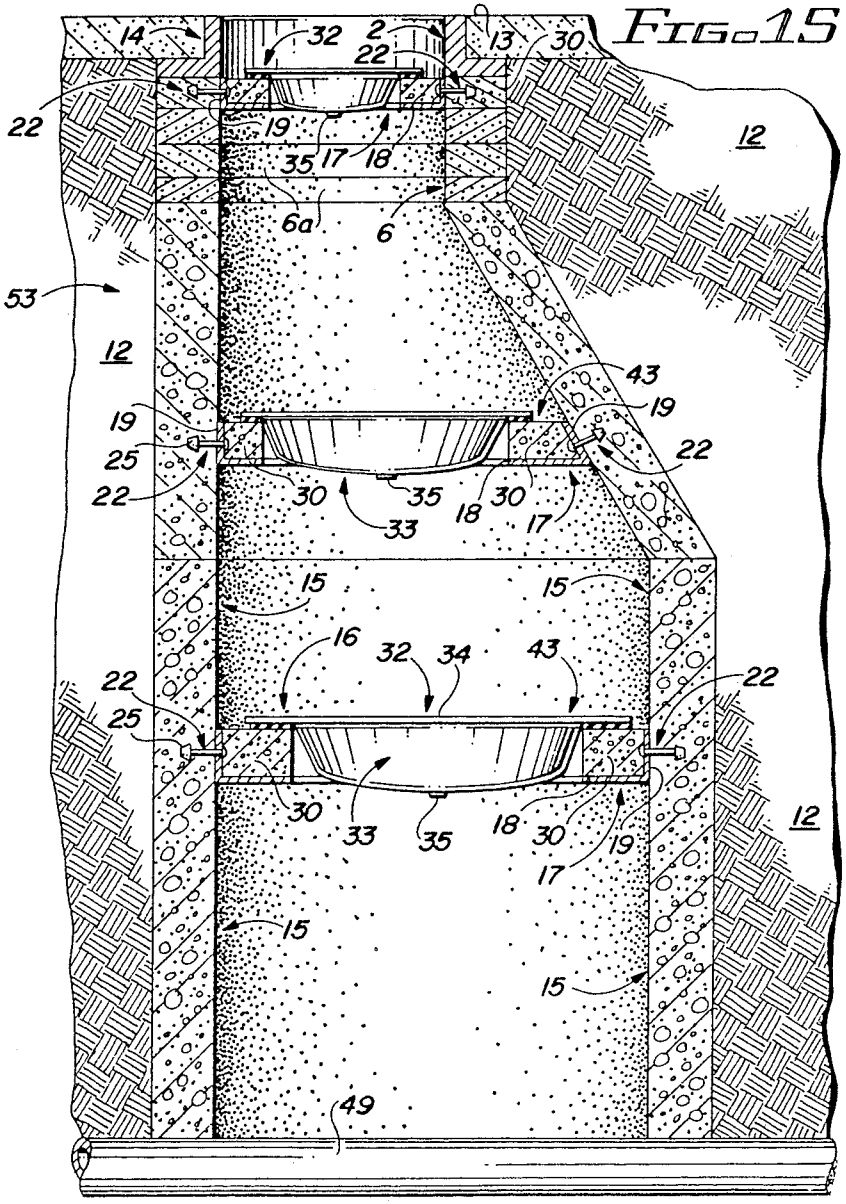
FIG. 15 is a sectional view of a typical eccentric manhole with a manhole seal of this invention mounted in the chimney, cone and base thereof.

Referring now to FIG. 15 of the drawings, an eccentric manhole structure 53 is illustrated, and includes a base 15, an eccentric cone 7 extending from the base 15 and a chimney 6 of substantially uniform diameter located on the top of the eccentric cone 7. As in the case of the chimney 6 provided in the concentric manhole structure 51 illustrated in FIG. 14, the chimney 6 element of the eccentric manhole structure 53 illustrated in FIG. 15 is constructed of discreet chimney rings 6*a*, in order to adjust the height of the manhole frame 2 and the manhole cover 4 and facilitate flush-mounting of the manhole cover 4 with the road surface 13. Further as in the case of the concentric manhole structure 51, a manhole seal 16 is located in each of the chimney 6, eccentric cone 7 and base 15 segments of the eccentric manhole structure 53, in order to further demonstrate the versatility of the method and apparatus for receiving manholes of this invention. It will be further appreciated from a consideration of the concentric manhole structure 51 illustrated in FIG. 14 and the eccentric manhole structure 53 illustrated in FIG. 15, that the seal structure 30 element of the manhole seal 16 in each case is constructed in the chimney 6, cone 7 and base 15, respectively, in the same manner as that illustrated in FIGS. 1–13 regarding installation of the manhole seal 16 in the cone 7, as heretofore described, using the form base 17, temporary form 27, the anchor bolts 22 and anchor plugs 25, respectively.

It will be appreciated from a consideration of FIGS. 7–15 of the drawings that the manhole seal of this invention is highly versatile, in that it can be utilized to seal substantially any manhole, regardless of the size, configuration or the state of repair of the manhole. Furthermore, as illustrated in FIGS. 14 and 15, the manhole seal 16 can be mounted at any depth in the chimney 6, cone 7 or base 15 of a manhole, from about 1/64 of an inch beneath the cover flange 3 of the manhole frame 2, to the bottom of the base 15, by simply matching the dimensions of the mount leg 19 and the base leg 18 of a flexible, resilient form base 17 to the dimensions of the chimney 6, cone 7 or base 15 at the selected depth in the manhole. However, in a most preferred embodiment of the invention, the seal structure 30 is at least about 12 inches thick and the bottom of the seal structure 30 is about 3 feet from the cover flange 3, to place the manhole insert 32 in the chimney 6 or cone 7 within about 2 feet of the cover flange 3, and easy reach from above. Furthermore, the state of repair of the manhole does usually not deter use of the manhole seal 16, since the form base 17 can be located at a level in the chimney 6, cone 7 or base 15 where the manhole wall is sufficiently structurally sound to securely mount the respective anchor bolts 22 and anchor plugs 25. Moreover, the opening in the form base 17 can be located such that it matches and aligns with the manhole mouth 10 of the manhole by simply offsetting the form base opening 26 to accommodate such an alignment. This alignment automatically determines the relative radial dimensions of the seal structure 30 at both the straight cone segment 8 and the offset cone segment 9 in an eccentric manhole 53, for example, in order to provide a secure foundation for mounting the removable manhole insert 32. For example, as illustrated in FIG. 8 of the drawings, the right-hand side of the seal structure 30 as the manhole seal 16 is viewed in FIG. 8, is thicker in diameter than the left-hand side of the seal structure 30. This disparity is necessary in order to align the form base opening 26 and the seal structure opening 31 in the manhole seal 16 with the manhole mouth 10, and facilitate convenient ingress and egress to and from the manhole. The same situation occurs in FIGS. 11 and 15, wherein the eccentric nature and design of the manhole 1 and the eccentric manhole 53 dictates that the seal structure 30 be thicker on the offset cone segment 9 side than on the straight cone segment 8 side of the cone 7. However, the top surface of the seal structure 30 should be at least ⅜ of an inch wide, in order to accommodate and seal the rim 34 of the manhole insert 32 of equal width.

Referring again to the drawings, it is apparent that the form base 17 and temporary form 27 elements of the manhole seal 16 may be shaped from any resilient material known to those skilled in the art which has sufficient structural integrity to maintain the desired donut or elliptical configuration when the concrete seal structure 30 is poured in the seal structure void 29, illustrated in FIG. 2. Alternatively, the form base 17 may be constructed of metal, with the mount leg 19 projected upwardly from the base leg 18 at an angle which corresponds to the angle of the corresponding straight cone segment 8 or offset cone segment 9 to which the mount leg 19 is attached.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An apparatus for sealing a manhole comprising a base having a base leg horizontally disposed in the manhole; a base leg opening provided in said base leg for accessing the manhole below said base leg; a mount leg upward-standing from the periphery of said base leg, said mount leg substantially conforming to the configuration of the wall of the manhole; mounting means engaging said mount leg and the wall of the manhole for securing said mount leg to the wall of the manhole; a masonry seal structure seated on said base leg and engaging said mount leg; and a seal structure opening provided in said masonry seal structure, said seal structure opening provided substantially coextensive with said base leg opening in said base leg of said base and insert means removably seated on said masonry seal structure, whereby water entering the manhole above said masonry seal structure and said insert means is trapped.

2. The apparatus of claim 1 further comprising at least one plug opening provided in said insert means and a plug normally seated in said plug opening for selectively draining said insert means responsive to removal of said plug from said plug opening.

3. The apparatus of claim 1 further comprising:

(a) insert seal means provided between said masonry seal structure and said insert means for sealing the interface between said masonry seal structure and said insert means from water encroachment; and (b) at least one plug opening provided in said insert means and a plug normally seated in said plug opening for draining said insert means responsive to removal of said plug from said plug opening.

4. The apparatus of claim 1 further comprising mount leg seal means disposed between said mount leg of said base and the wall of the manhole for sealing the interface between said mount leg and the wall of the manhole from water encroachment.

5. The apparatus of claim 1 further comprising insert seal means provided between said masonry seal structure and said insert means for sealing the interface between said masonry seal structure and said insert means from water encroachment.

6. The apparatus of claim 5 further comprising valve means provided in said insert means for equalizing pressure in the manhole, strap means carried by said insert means for removing said insert means from said masonry seal structure, at least one plug opening provided in said insert means and a plug normally seated in said plug opening for draining said insert means responsive to removal of said plug from said plug opening.

7. The apparatus of claim 6 further comprising mount leg seal means disposed between said mount leg of said base and the wall of the manhole for sealing the interface between said mount leg and the wall of the manhole from water encroachment.

8. The apparatus of claim 1 wherein said insert means further comprises a bowl-shaped insert having a rim adapted to rest on said masonry seal structure a dish extending inwardly of said rim in concave relationship and valve means provided in said dish for equalizing pressure in the manhole above and below said apparatus.

9. The apparatus of claim 8 further comprising insert seal means provided between said masonry seal structure means and said rim for sealing the interface between said masonry seal structure means and said rim from water encroachment.

10. The apparatus of claim 8 further comprising strap means attached to said dish for removing said insert from said masonry seal structure and accessing the manhole below said base.

11. The apparatus of claim 8 further comprising:

(a) at least one plug opening provided in said dish and a plug normally seated in said plug opening for selectively draining said insert responsive to removal of said plug from said plug opening; and (b) strap means attached to said dish for removing said insert from said masonry seal structure and accessing the manhole below said base.

12. The apparatus of claim 11 further comprising float means carried by said plug and said strap means for locating said plug and said strap means when said insert is filled with water.

13. An apparatus for sealing a manhole having a manhole chimney, cone and base, said apparatus comprising a flexible base having a base leg horizontally disposed in the manhole at a selected depth therein; a base leg opening provided in said base leg for accessing the manhole below said base leg; a chimney leg upward-standing from the periphery of said base leg, said chimney leg substantially conforming to the configuration of the wall of the manhole; mounting means engaging said chimney leg and the wall of the manhole for securing said chimney leg to the wall of the manhole; a masonry seal structure seated on said base leg and engaging said chimney leg and the wall of the manhole; and a seal structure opening provided in said masonry seal structure, said seal structure opening provided substantially coextensive with said base leg opening in said base leg of said flexible base and a dish-shaped manhole insert having a rim adapted for removably seating on said masonry seal structure and a concave dish extending inwardly of said rim, whereby water entering the manhole above said manhole insert is trapped by said manhole insert.

14. The apparatus of claim 13 further comprising valve means provided in said dish for equalizing the pressure in the manhole, a plug opening provided in said dish for selectively draining said manhole insert responsive to removal of said plug from said plug opening and strap means attached to said dish for removing said manhole insert from said seal structure means and accessing the manhole below said seal structure means.

15. The apparatus of claim 14 further comprising float means carried by said plug and said strap means, for locating said plug and said strap means when said insert is filled with water.

16. The apparatus of claim 13 further comprising insert seal means provided between said masonry seal structure and said rim for sealing the interface between said masonry seal structure and said rim from water encroachment.

17. The apparatus of claim 13 further comprising chimney leg seal means disposed between said chimney leg of said base and the wall of the manhole for sealing the interface between said chimney leg and the wall of the manhole from water encroachment.

18. The apparatus of claim 13 further comprising:

(a) insert seal means provided between said masonry seal structure and said rim for sealing the interface between said masonry seal structure and said rim from water encroachment;

(b) chimney leg seal means disposed between said chimney leg of said base and the wall of the manhole for sealing the interface between said chimney leg and the wall of the manhole from water encroachment;

(c) valve means provided in said dish for equalizing the pressure in the manhole, a plug opening provided in said dish for selectively draining said manhole insert responsive to removal of said plug from said plug opening and strap means attached to said dish for removing said manhole insert from said seal structure means and accessing the manhole below said seal structure; and (d) float means carried by said plug and said strap means for locating said plug and said strap means when said insert is filled with water.

19. An apparatus for sealing a manhole, said apparatus comprising:

(a) a seal structure mounted in the manhole at a selected depth in the manhole, said seal structure further comprising a flexible base having a base leg horizontally disposed in the manhole; a base leg opening provided in said base leg for accessing the manhole below said base leg a mount leg upward-standing from the periphery of said base leg, said mount leg substantially conforming to the configuration of the wall of the manhole; mounting means engaging said mount leg and the wall of the manhole for securing said mount leg to the wall of the manhole; a masonry seal structure seated on said base leg and engaging said mount leg and the wall of the manhole; and a seal structure opening provided in said masonry seal structure, said seal structure opening provided substantially coextensive with said base leg opening in said base leg of said flexible base; and (b) a dish-shaped manhole insert having a rim adapted for removably seating on said masonry seal structure, a concave dish extending inwardly of said rim; valve means provided in said dish for equaling the pressure in the manhole; a plug opening provided in said dish and a plug adapted for insertion in said plug opening, for selectively draining said manhole insert responsive to removal of said plug from said plug opening; and strap means attached to said dish for removing said manhole insert from said seal structure means and accessing the manhole below said seal structure means, whereby water entering the manhole above said seal structure and said manhole insert is trapped by said seal structure and said manhole insert.

20. The apparatus of claim 19 further comprising float means carried by said plug and said strap means, for locating said plug and said strap means when said insert is filled with water.

21. The apparatus of claim 19 further comprising mount leg seal means disposed between said mount leg of said base and the wall of the manhole for sealing the interface between said mount leg and the wall of the manhole from water encroachment and rim seal means provided between said rim and said masonry seal for sealing the interface between said rim and said masonry seal from water encroachment.

22. The apparatus of claim 21 further comprising float means carried by said plug and said strap means, for locating said plug and said strap means when said insert is filled with water.

23. A method for sealing manholes which includes the steps of mounting a form base having a form base opening in the manhole; inserting a form in the manhole and resting the form on said form base to define an annulus between said form and the side of the manhole; pouring concrete in said annulus to define a seal structure and a seal structure opening which communicates with said form base opening; and inserting a manhole insert in the manhole and resting the manhole insert on said seal structure to block the flow of water through said form base opening and said seal structure opening.

24. The method according to claim 23 further comprising the step of providing a first seal between said form base and the side of the manhole for sealing the interface between said form base and the side of the manhole from water encroachment therebetween.

25. The method according to claim 23 further comprising the step of providing a second seal between said seal structure and said manhole insert for sealing the interface between said seal structure and said manhole insert from water encroachment therebetween.

26. The method according to claim 23 further comprising the steps of:

(a) providing a first seal between said form base and the side of the manhole for sealing the interface between said form base and the side of the manhole from water encroachment therebetween; and (b) providing a second seal between said seal structure and said manhole insert for sealing the interface between said seal structure and said manhole insert from water encroachment therebetween.

27. The method according to claim 23 further comprising the step of providing a plug opening in said manhole insert and a plug adapted for removable insertion in said plug opening for selectively draining said manhole insert responsive to removal of said plug from said plug opening.

28. The method according to claim 23 further comprising the step of providing a lift strap on said manhole insert for manipulating said manhole insert to and from said seal structure.

29. The method according to claim 23 further comprising the steps of:

(a) providing a plug opening in said manhole insert and a plug adapted for removable insertion in said plug opening for selectively draining said manhole insert responsive to removal of said plug from said plug opening; and (b) providing a lift strap on said manhole insert for manipulating said manhole insert to and from said seal structure.

30. The method according to claim 29 further comprising the steps of:

(a) providing a first seal between said form base and the side of the manhole for sealing the interface between said form base and the side of the manhole from water encroachment therebetween; and (b) providing a second seal between said seal structure and said manhole insert for sealing the interface between said seal structure and said manhole insert from water encroachment therebetween.

31. The method according to claim 23 further comprising the step of providing a valve in said manhole insert for relieving pressure in the manhole.

32. The method according to claim 31 further comprising the steps of:

(a) providing a first seal between said form base and the side of the manhole for sealing the interface between said form base and the side of the manhole from water encroachment therebetween;

(b) providing a second seal between said seal structure and said manhole insert for sealing the interface between said seal structure and said manhole insert from water encroachment therebetween;

(c) providing a plug opening in said manhole insert and a plug adapted for removable insertion in said plug opening for selectively draining said manhole insert responsive to removal of said plug from said plug opening; and (d) providing a lift strap on said manhole insert for manipulating said manhole insert to and from said seal structure.

33. A method for sealing manholes which includes the steps of mounting a resilient form base having a base leg, a base leg opening provided in said base leg and a mount leg bordering said base leg, at a selected depth in the manhole; inserting a round, resilient form in the manhole and resting the form on said form base to define an annulus between said form and the side of the manhole; pouring concrete in said annulus to define a seal structure and a seal structure opening which communicates with said form base opening; and inserting a manhole insert having a flat rim and a dish configured inwardly of said rim, in the manhole and resting said flat rim of said manhole insert on said seal structure to block said seal structure opening and said form base opening and the flow of water through the manhole.

34. The method according to claim 33 further comprising the steps of:

(a) providing a first seal between said mount leg of said form base and the side of the manhole for sealing the interface between said mount leg and the side of the manhole from water encroachment therebetween;

(b) providing a second seal between said seal structure and said rim of said manhole insert for sealing the interface between said seal structure and said rim from water encroachment therebetween;

(c) providing a plug opening in said dish of said manhole insert and a plug adapted for removable insertion in said plug opening for selectively draining said manhole insert responsive to removal of said plug from said plug opening; and (d) providing a lift strap on said dish of said manhole insert for manipulating said manhole insert to and from said seal structure and the manhole.

* * * * *